United States Patent [19]

Johansson

[11] 4,399,572

[45] Aug. 23, 1983

[54] SEAT OF A PATIENT-LIFTING DEVICES

[76] Inventor: Hans A. V. Johansson, Box 61, Eslov, Sweden, S-241 00

[21] Appl. No.: 256,474

[22] Filed: Apr. 22, 1981

[30] Foreign Application Priority Data

May 5, 1980 [SE] Sweden ..... 8003342

[51] Int. Cl.[3] ..... A61G 7/08

[52] U.S. Cl. ..... 5/81 R; 4/251; 5/83; 297/DIG. 2; 297/DIG. 4; 297/312; 297/440; 297/443; 297/452

[58] Field of Search ..... 297/345, 346, 312, 201, 297/DIG. 10, DIG. 2, 443, 452, DIG. 4; 5/81 R, 83, 87, 90; 312/257 A; 4/561, 560, 564, 566, 578

[56] References Cited

U.S. PATENT DOCUMENTS

| | | | |
|---|---|---|---|
| 2,799,323 | 7/1957 | Berg | 297/312 |
| 3,116,492 | 1/1964 | Christensen | 5/83 X |
| 3,196,465 | 7/1965 | Montgomery . | |
| 3,829,916 | 8/1974 | James | 5/81 R |
| 3,981,484 | 9/1976 | James | 5/81 R |
| 4,168,552 | 9/1979 | Austin | 4/251 X |
| 4,332,419 | 6/1982 | Vogel | 297/452 |

FOREIGN PATENT DOCUMENTS

| | | | |
|---|---|---|---|
| 47394 | 6/1889 | Fed. Rep. of Germany | 297/312 |
| 1083655 | 7/1954 | France . | |
| 354568 | 3/1973 | Sweden . | |
| 376167 | 5/1975 | Sweden . | |
| 1277291 | 6/1972 | United Kingdom | 297/312 |

*Primary Examiner*—James T. McCall
*Attorney, Agent, or Firm*—Bacon & Thomas

[57] ABSTRACT

The present invention relates to a seat at patient-lifting devices, said seat comprising a carrier frame (6) mounted on a hoisting gear (2) and support means (9, 10) extending between outwardly directed carrier frame portions (7, 8).

Since the seats at patient-lifting devices often become very dirty, they need to be cleaned in special cleaning devices, so called decontamination devices. However, the present seats are not suitable for cleaning in cleaning devices of this type and time-consuming measurements are required to loosen and reengage the seats.

In order to eliminate said problems and provide a seat that may be cleaned in especially efficient cleaning devices and further may be quickly and safely disconnected and connected in a simple manner the seat according to the invention is characterized by the features that the carrier frame (6) comprises two separate sitting means (12 and 13) spaced from each other to provide a seat with an opening (27) therein, whereby each sitting means (12 and 13 respectively) and/or the carrier frame (6) has a coupling device (14 and 15 respectively) adapted to permit fixing of the sitting means (12 and 13 respectively) above the support means (9 and 10 respectively) by moving the sitting means (12 and 13 respectively) into engagement with the carrier frame (6) and whereby each sitting means (12 and 13 respectively) and/or carrier frame (6) has a position indicator (15, 16 and 17, 18 respectively) arranged such that any one from above may determine whether the sitting means (12 and 13 respectively) is in fixed position (A and B respectively) above the support means (9 and 10 respectively).

10 Claims, 5 Drawing Figures

SEAT OF A PATIENT-LIFTING DEVICES

The present invention relates to a seat for a patient-lifting devices, said seat comprising a carrier frame mounted on a hoisting gear and support means extending between outwardly directed carrier frame portions.

Since the seats of patient-lifting devices often become very dirty, they need to be cleaned in special cleaning devices, so called decontamination devices. However, the present seats are not suitable for cleaning in cleaning devices at this time and time-consuming measurements are required to loosen and reengage the seats.

The object of the present invention is to eliminate said problems and provide a seat that may be cleaned in especially efficient cleaning devices and further may be quickly and safely disconnected and connected in a simple manner. This is arrived at according to the invention by providing the seat with the features defined in the claims.

The invention will be further described hereinafter with reference to the accompanying drawings, wherein FIG. 1 is a perspective view over a seat at a patient-lifting device mounted on a transport wagon;

Figure 1:
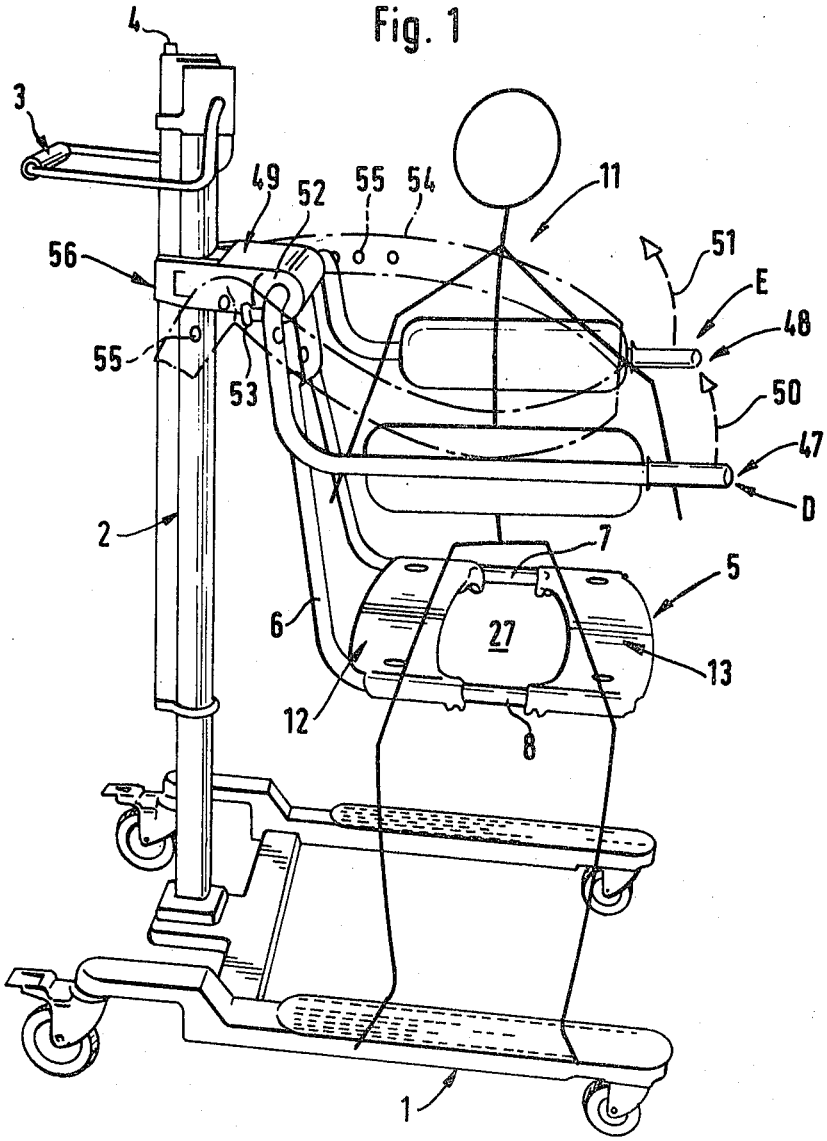

FIG. 1 illustrates a wheeled frame 1 with a hoisting gear 2 which is raisable by means of a pump device (not shown) controlled by pumping a handle 3 up and down. The hoisting gear 2 may be lowered by pressing down a control button 4 which releases a guiding device (not shown). Hoisting gears of this and similar types are previously known and therefore not further described.

Figure 2:
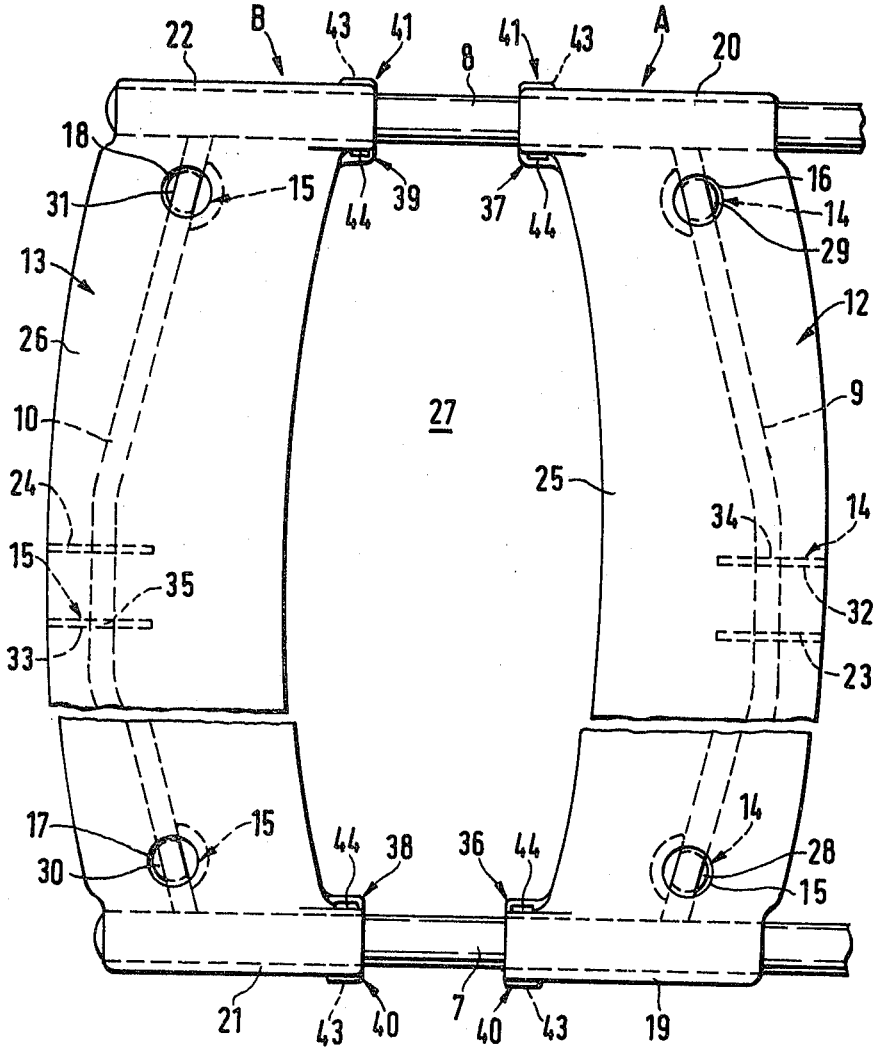
FIG. 2 is a plan view of a portion of the seat.

A seat 5 is mounted on the hoisting gear 2, said seat comprising a carrier frame 6 with two carrier frame portions 7 and 8 extending outwards from the hoisting gear and two support means 9 and 10 connecting the carrier frame portion 7 to the carrier frame portion 8 (FIG. 2).

In order to provide a seat permitting efficient cleaning at first hand of the portions thereof normally in contact with the patients 11 and permitting removal of said portions in a simple manner and reengagement in a simple manner at predetermined locations, the carrier frame 6 comprises two separate sitting means 12 and 13 spaced from each other to provide a seat with an opening 27 therein whereby each sitting means 12 and 13 respectively and/or the carrier frame 6, has a coupling device 14 and 15 respectively adapted to permit fixing of the sitting means 12 and 13 respectively, above the support means 9 and 10 respectively, by moving the sitting means 12 and 13 respectively, into engagement with the carrier frame 6 and whereby each sitting means 12 and 13 respectively and/or the carrier frame 6 has a position indicator 15, 16 and 17, 18 respectively, arranged such that any one from above may determine whether the sitting means 12 and 13 respectively, is in fixed position A and B respectively above the support means 9 and 10 respectively.

For obtaining an embodiment which facilitates application of the sitting means 12 and 13 respectively, each sitting means 12 and 13 respectively may have opposite end portions 19, 20 and 21, 22 respectively adapted to grasp over the outwardly directed carrier frame portions 7 and 8 respectively, whereby the sitting means 12 and 13 respectively, on one hand, is positionable with its end portions 19, 20 and 21, 22 respectively, grasping over the carrier frame portions 7 and 8 respectively, beside their fixing positions A and B respectively, and on the other hand is movable along the carrier frame portions 7 and 8 respectively, towards the respective support means 9, 10, until it reaches the fixing positions A and B respectively.

Each coupling device preferably comprises at least one closure portion 23 and 24 respectively provided on the sitting means 12 and 13 respectively, and via which the sitting means are pressed onto the support means 9 and 10 respectively, whereby the position indicator comprises at least one opening 15 and/or 16 and 17 and/or 18 respectively, provided in the sitting means and located above the support means 9 and 10 respectively, when said sitting means are fixed, such that the support means can be from above seen through the openings in order to decide whether said openings are in their desired positions relative to said support means.

In order to facilitate mounting, the shape of the sitting means 12, 13 are identical, they are both made of plastics material and they are resilient.

Each sitting means 12 and 13 respectively, becomes especially pleasant to sit on and stable in shape by being provided with a longitudinal sitting portion 25 and 26 respectively, extending along the support means 9 and 10 respectively, and being curved down on both sides thereof, whereby each sitting means on both sides of the sitting portion has end portions 19, 20 and 21, 22 respectively, which engage the carrier frame portions 7 and 8 respectively.

The sitting means 12 and 13 respectively, are mounted in a simple manner. The sitting means are thereby placed between the support means 9, 10 and moved towards the support means onto which it shall be fixed. When the sitting means 12 or 13 moved in said direction a certain distance, the claws 28, 29 or 30, 31 of the coupling device 14 or 15 will slide under the support means 9 or 10, whereby the end surfaces 32 or 33 of the closure portions 23 or 24 slide over the support means 9 or 10. At continued movement of the sitting means 12 or 13, the sitting portions 25 or 26 thereof will, due to their flexibility, deflect upwards until the groove 34 or 35 has reaches the support means 9 or 10, whereby the sitting portions 25 or 26 return to normal shape and the sitting means 12 or 13 is fixed at the support means 9 or 10.

Preferably the support means 9 or 10 extends through the center of the openings 15, 16 or 17, 18 when the sitting means 12 or 13 is in fixed position A or B, since this facilitates immediate control frame above of eventual deviations and thereby misplacement of the sitting means 12 or 13 which are thus not fixed.

In order to ensure that no accident occurs if despite all any sitting element 12 or 13 should not be fixed but slide away when the patient 11 tries to sit down, a fall is prevented by placing the support means 9, 10 so close to each other that the patient cannot fall down between them.

At disengagement of the sitting means 12 or 13, said means are preferably shock-loaded in opposite direction such that the closure means 23 or 24 loosen their grip on the support means 9 or 10 and the sitting means are displaced so far that the claws 28, 29 or 30, 31 no longer grip under the support means, whereafter the sitting means may be lifted upwards.

Figure 3:
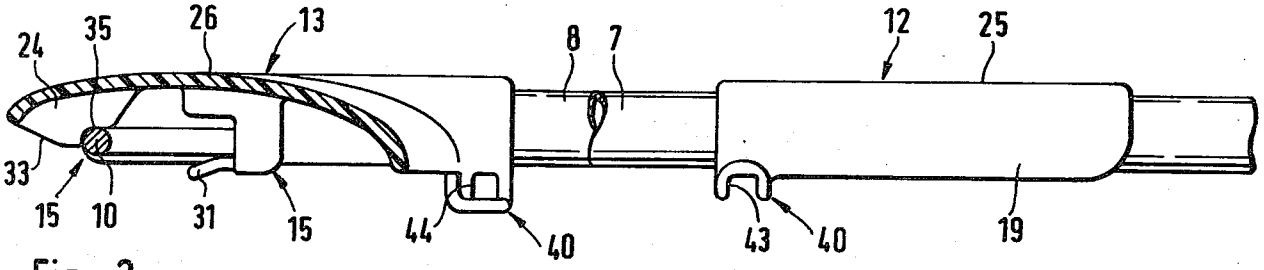
FIG. 3 is a side view of the portion of the seat shown in FIG. 2, whereby a part thereof is in section.
Figure 5:
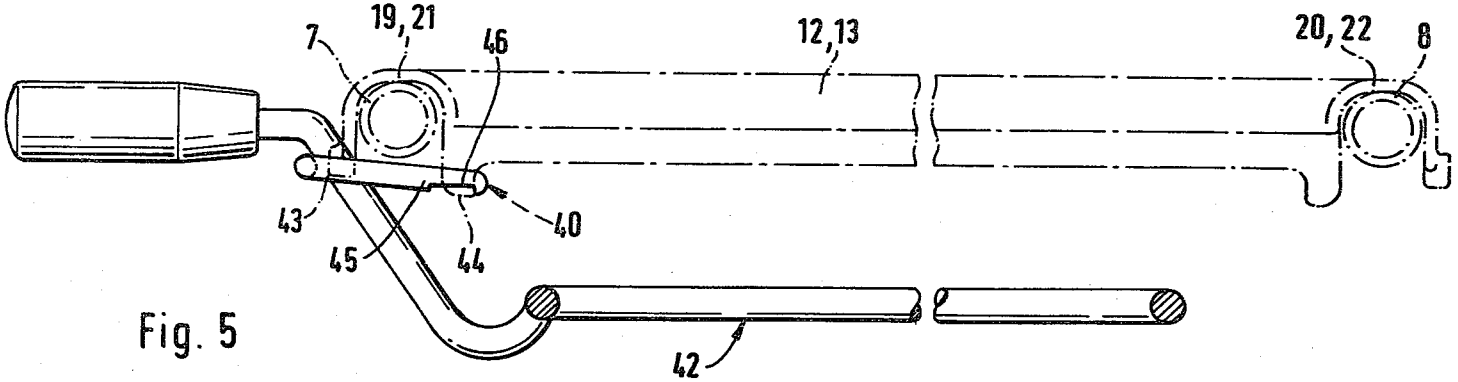
FIG. 5 is a side view of the seat and pan carrier in FIG. 4.
Figure 4:
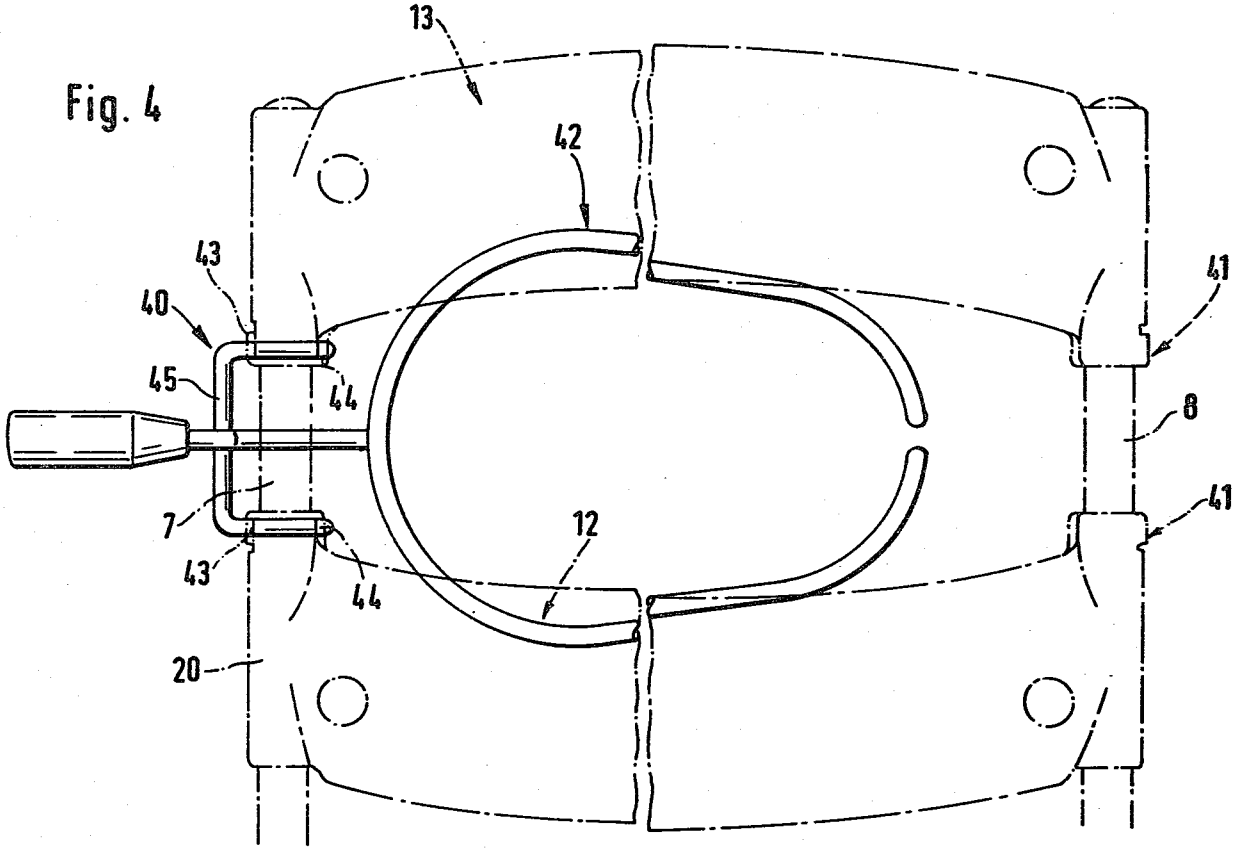
FIG. 4 is a plan view of a portion of the seat and a pan carrier mounted thereon.

Each sitting means includes at least one fixing portion 36, 38 and/or 37, 39, whereby each pair adjacent fixing portions 37, 39 and/or 36, 38 forms a fixing device 40 and/or 41 for a pan carrier 42 (FIGS. 4 and 5). For permitting quick-connection of the pan carrier, each fixing portion 36-39 comprises a guiding groove 43 and an opening 44 inside thereof (FIG. 3).

The pan carrier 42 comprising a fork 45 with hook portions 46, is applied by placing the fork 45 in the respective guiding groove 43 and moving the pan carrier 42 towards the seat until the hook portions 46 engage the openings 44. Since the centre of gravity of the pan carrier 42 lies within the fixing portions (this is true especially when a pan (not shown) is placed thereon), the hook portions 46 will remain in engaging position (FIG. 5) without requiring any special measurements therefore.

Since the patient 11 sits with one side turned towards the hoisting gear 2, it is suitable to provide the carrier frame 6 with two back supports 47 and 48, of which one support 47 functions as a handle onto which the patient may hold while she may lean backwards, against the other support 48. This arrangement as well as the design of the seat 5 permits for the patient to be placed, as desired, with the left or right side turned towards the hoisting gear 2.

Each back support 47, 48 is swingably and removably mounted in a bracket 49, such that said support may be swung from operating positions D and upwards (arrows 50 and 51) towards rest positions (not shown) substantially on the same side of the hoisting gear 2 as the handle 3. Each back support 47, 48 is also removable by being provided with a pin (not shown) positioned behind a plate 52 of the bracket 49 said plate 52 having a recess (not shown) therein through which the pin may pass. Said recess is located such that withdrawing of the back support 47 and 48 respectively, may occur only when it is swung to a position between the operating and rest positions. Hereby, it is guaranteed that the back support is not loosened unintentionally.

In order to prevent the patient 11 from unexpectedly glide off the seat 5, each back support 47, 48 may be provided with a fixing device beside the bracket 49, e.g. in the form of a retaining button 53, and a harness 54 runs therebetween and around the patient 11. The harness 54 has several holes 55 for providing spaces of various size for the patient 11 so that he or she has a certain range of movement despite the harness.

The invention is not limited to the embodiment described above, but may vary within the scope of the following claims. Finally, it may also be noted that the carrier frame 6 is mounted on the hoisting gear 2 via a fitting 56 which is vertically movable on the hoisting gear for adjusting the lifting range of the seat.

What I claim is:

1. A seat for a patient-lifting device, the seat comprising a carrier frame (6) mounted on a hoisting gear (2) and having support means (9 and 10) running between outwardly extending carrier frame portions (7 and 8), said carrier frame (6) comprising two separate sitting means (12 and 13) spaced from each other to provide a seat with an opening (27) therein, whereby each sitting means (12 and 13 respectively) and/or the carrier frame (6) has a coupling device (14 and 15 respectively) adapted to permit fixing of the sitting means (12 and 13 respectively) above the support means (9 and 10 respectively) by moving the sitting means (12 and 13 respectively) into engagement with the carrier frame (6) and whereby each sitting means (12 and 13 respectively) and/or the carrier frame (6) has a position indicator (15, 16 and 17, 18 respectively) arranged such that any one from above may determine whether the sitting means (12 and 13 respectively) is in-fixed position (A and B respectively) above the support means (9 and 10 respectively).

2. The seat as defined in claim 1, wherein each sitting means (12 and 13 respectively) has opposite end portions (19, 20 and 21, 22 respectively) adapted to grasp over the outwardly directed carrier frame portions (7 and 8 respectively), whereby the sitting means (12 and 13 respectively) on one hand, positionable with its end portions (19, 20 and 21, 22 respectively) grasping over the carrier frame portions (7 and 8 respectively) beside their fixing positions (A and B respectively) and on the other hand, is movable along the carrier frame portions (7 and 8 respectively) towards the respective support means (9, 10) until it reaches the fixing positions (A and B respectively).

3. The seat as defined in claim 1 or 2, wherein each coupling device (14 and 15 respectively) comprises at least one closure portion (23 and 24 respectively) provided on the sitting means (12 and 13 respectively) and via which the sitting means are pressed onto the support means (9 and 10 respectively), whereby the position indicator comprises at least one opening (15 and/or 16 and 17 and/or 18 respectively) provided in the sitting means and located above the support means, when said sitting means are fixed, such that the support means can be seen from above through the openings in order to decide whether said openings are in their desired positions relative to said support means.

4. The seat as defined in claim 1 or 2, wherein the shape of the sitting means (12, 13) are identical, and they are both made of plastics material that are resilient.

5. The seat as defined in claim 1 or 2, wherein each sitting means (12 and 13 respectively) is provided with a longitudinal sitting portion (25 and 26 respectively), extending along the support means (9 and 10 respectively) and is curved down on both sides thereof, whereby each sitting means on both sides of the sitting portion has end portions (19, 20 and 21, 22 respectively) which engage the carrier frame portions (7 and 8 respectively).

6. The seat as defined in claim 1 or 2, wherein the distance between the support means (9, 10) is selected such that said means provide an obstacle to fall for the patient if one or both sitting means (12 and/or 13) are misplaced.

7. The seat as defined in claim 1 or 2, wherein each sitting means (12, 13) comprises at least one fixing device (40 and/or 41) for quick-connection of a pan carrier.

8. The seat as defined in claim 1 or 2, wherein the carrier frame (6) comprises two back supports (47, 48) extending outwards in the same direction as the carrier frame portions (7, 8), each back support is swingable from an operating position (D, E) to a rest position, and is removable by withdrawing thereof from a bracket (49) when said support is in a position between the operating and rest positions.

9. The seat as defined in claim 1 or 2, wherein the carrier frame (6) comprises two back supports (47, 48) extending outwards from opposite sides of a bracket (49) and in the same direction as the carrier frame portions (7, 8), whereby each back support adjacent from bracket is provided with a fixing device (53) for attachment of a harness (54) extending from one fixing device to the other and around the patient (11).

10. The seat as defined in clam 1 or 2, wherein the carrier frame (6) is movable in a vertical direction on the hoisting gear (2).

* * * * *